United States Patent [19]

Corl

[11] 4,078,736

[45] Mar. 14, 1978

[54] AUTOMATIC DOFFING METHOD

[75] Inventor: James G. Corl, La Vale, Md.

[73] Assignee: Celanese Corporation, Charlotte, N.C.

[21] Appl. No.: 722,845

[22] Filed: Sep. 13, 1976

Related U.S. Application Data

[62] Division of Ser. N. 588,988, Jun. 20, 1975, abandoned.

[51] Int. Cl.[2] ..... B65H 67/04

[52] U.S. Cl. ..... 242/35.5 A; 242/18 DD; 242/19

[58] Field of Search ..... 242/35.5 A, 35.5 R, 242/35.6 R, 18 R, 18 A, 18 PW, 19, 18 DD; 57/34 R, 53

[56] References Cited

U.S. PATENT DOCUMENTS

| | | | |
|---|---|---|---|
| 3,224,692 | 12/1965 | Nugent | 242/19 |
| 3,476,328 | 11/1969 | Shimai et al. | 242/35.5 R |
| 3,559,903 | 2/1971 | McDermott et al. | 242/18 PW |
| 3,682,403 | 8/1972 | Willis | 242/18 A |
| 3,761,029 | 9/1973 | Seney | 242/18 A |
| 3,791,126 | 2/1974 | Kose et al. | 242/35.5 A UX |
| 3,801,030 | 4/1974 | Kobatake et al. | 242/35.5 A X |
| 3,811,631 | 5/1974 | Mayer et al. | 242/18 R |
| 3,820,730 | 6/1974 | Endo et al. | 242/35.5 A X |

*Primary Examiner*—Stanley N. Gilreath
*Attorney, Agent, or Firm*—Robert J. Blanke

[57] ABSTRACT

Method and apparatus for doffing filled yarn packages from a metier and donning empty package is disclosed. The apparatus includes an upper frame and a lower frame which are mounted together on a track extending along the length of the metier. Each frame includes an arm operable to swing the package away from the cam and an arm for engaging the yarn, severing the yarn and throwing on the yarn ends after the filled package has been replaced with an empty package. The apparatus includes controls for coordinating the movements of the various components.

5 Claims, 30 Drawing Figures

AUTOMATIC DOFFING METHOD

This is a division, of application Ser. No. 588,988, filed June 20, 1975, now abandoned.

BACKGROUND OF THE INVENTION

This invention relates to yarn winding and, more particularly, to methods and apparatus for doffing and donning yarn packages on a metier.

In accordance with conventional practice, synthetic yarns, such as cellulose acetate, are extruded through dies and pass downwardly through a drying cabinet assembly as continuous filaments. The ends emerge from the drying cabinet assembly at the winding stations which are spaced at uniform intervals along the length of the metier. One type of metier that has been in use for many years has a rotary shaft that extends along the length of the metier. Feed rolls are fixed on the shaft at each winding station. The shaft turns continuously and the ends are wrapped on the feed roll, which maintains a substantially constant tension in the yarn ends. At each winding station, a rotary cam is positioned above the feed roll for winding two of the ends on tubular packages which are mounted on a mandrel or the upper package spindle. Another rotary cam is mounted below the feed roll for winding the other two yard ends on packages mounted on the lower package spindle. Both of the cams rotate continuously and each cam has a pair of spiral grooves which cause the yarn to traverse across the package during a winding operation. As the yarn builds on the bobbins, the spindles move progressively away from the cam, although the surface of the package remains in driving engagement with the cam.

Typically, many winding stations are provided on each metier and operators are employed to doff the filled packages periodically and to donn the take-up tubes or packages on the mandrels. In order to accomplish this, the operator must sever the yarn ends between the cam and the feed roll, remove the yarn package, replace the yarn package with an empty take-up package and throw on the yarn ends. During this process, the ends that have been severed accumulate on the feed roll and after making the throw on, the operator removes the waste yarn. It may take the operator as long as one to two hours, or more, to complete the doffing of an entire metier, depending upon the denier of the yarn and the size of the yarn packages, and the number of yarn ends being extruded on the metier.

In a plant that has many metiers, it is necessary to maintain a schedule for the operators to make maximum use of their time. Significant savings in labor costs could be realized if the time required for making the doff could be significantly reduced. This would provide greater flexibility in scheduling the individual operators. Furthermore, automation of the doffing operation would permit the use of less skilled labor, without reducing the percentage of successful doffs.

Previous attempts to design equipment for automatically doffing metiers typically are prohibitively expensive. A factor in contributing to the high cost of this prior equipment is the means for positioning accurately the apparatus relative to each winding station. Alignment of the apparatus is necessary to provide the proper interaction between the components on the metier and the components on the doffing apparatus. Another handicap in designing doffing apparatus is the presence of a potentially explosive atmosphere around the metiers, which prohibits the use of electrical equipment in which sparking may occur. Thus, for protection against this hazard, electrical equipment should not be used.

SUMMARY OF THE INVENTION

It is a principal object of the invention to provide an improved doffing method and apparatus for automatically severing yarn ends while they are being wound on a yarn package and, after manual removal of a filled package and replacement of an empty package automatically throwing on the yarn ends to resume winding of a new package.

It is yet another principal object of the invention to provide a doffing method and apparatus which is capable of automatically travelling from one winding station to the next along the length of the metier while aligning itself at each successive station.

In accordance with a preferred embodiment of the invention, the apparatus includes a primary frame which is supported between an upper track and a lower track for movement along the length of the metier. An actuating means is provided on the primary frame for displacing the lower package spindle away from the cam when the frame is aligned with one of the winding stations. Yarn engaging means is also provided on the primary frame for severing both of the yarn ends being wound in packages on the lower package spindle. The ends are severed between the feed roll and the lower cam. The severing means includes means for drawing the waste yarn into a receptacle on the primary frame. The severing means also accomplishes the throw-on after the operator has removed the packages and placed a pair of empty take-up tubes on the lower mandrel.

A secondary frame is supported on the primary frame and the upper track and is movable relative to the primary frame. The primary frame is movable a sufficient distance along the upper track to be aligned with the next winding station while the secondary frame is aligned with the preceding winding station. The secondary frame has an actuator positioned for displacing the upper mandrel away from the cam and severing means for severing the yarns between the feed roll and the upper cam. The severing means on the secondary frame also includes means for drawing the yarn to a waste receptacle on the primary frame after the ends have been severed. The severing means on the secondary frame is movable to accomplish throw-on of the yarns after the empty take-up tubes have been placed on the mandrel.

The sequence of operation of the components of the apparatus is controlled by a timer which operates various valves controlling air flow in a pneumatic circuit. The primary and secondary frames are driven by air motors engaging the upper track and the frames are provided with stop means to maintain a predetermined spacing between them as they progress along the track. The apparatus accommodates for dimensional variations longitudinally of the metier and does not require close tolerances in aligning the frames with the winding stations. When positioned at one end of the metier, the doffing apparatus progresses automatically from one winding station to the next along the full length of the metier and when it reaches the opposite end, the apparatus stops.

Important features of the invention include the severing means which has a severing head which is movable laterally of the yarn ends. The severing head is extendable toward yarn ends being fed to position the ends in slots where they are severed by cutters within the head. The severed end from the feed roll is drawn to waste through the head. Subsequently, the throw-on is made by positioning the head adjacent the empty packages and moving the head laterally to align both ends with the respective grooves in the packages. The timer controls the movements of the actuator and the severing head and the motors controlling the movement of the frames. Thus, it is unnecessary to provide indexing cams or other guides on the metier except for the upper and lower tracks.

DETAILED DESCRIPTION OF THE DRAWINGS

This preferred embodiment of the invention is illustrated in the accompanying drawings in which.

DETAILED DESCRIPTION OF A PREFERRED EMBODIMENT OF THE INVENTION

Figure 1:
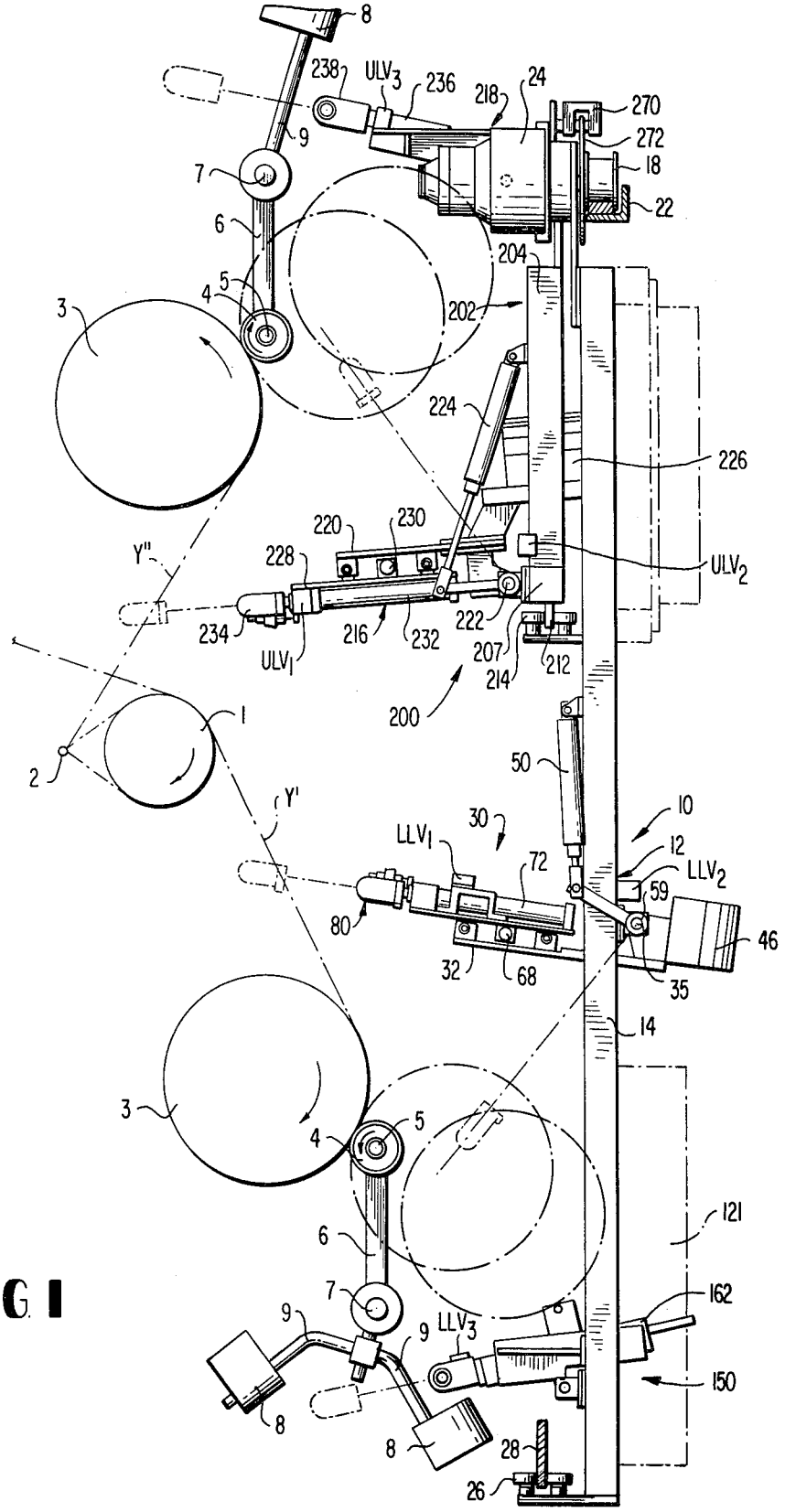
FIG. 1 is a side elevational view, partially schematic, of a doffing machine according to the invention.

FIG. 1 illustrates a yarn winding station of a metier which comprises a continuously rotating feed roll 1 on which are wrapped a plurality of yarns Y received from the dies at the base of the extruder. The term "yarn" is used herein to mean synthetic monofilaments, or filament yarn, or other filamentary material that is suitable for winding into packages on a metier of the type disclosed herein. Preferably, four yarns are supplied to the feed roll and spaced apart on the surface of the roll. Two yarns Y′ pass through guides 2 and are transferred to a lower yarn winding assembly. The remaining two yarns Y″ pass through similar guides disposed adjacent the guides 2 and are transferred to an upper yarn winding assembly.

Each of the winding assemblies comprises a power-driven, rotary cam 3 and a pair of take-up tubes or packages 4 mounted side-by-side over a mandrel which is journalled for rotation on a spindle 5. The spindle 5 is fixed to a lever 6 which is pivotally mounted on a shaft 7. Crank arms 9 are fastened to the lever 6 to support counterweights 8. The counterweights 8 serve to bias the packages 4 into driven engagement with the cam 3.

The packages 4 are of a conventional tube type and each tube has a length equal to about one-half the width of the cam 3. One of the yarns is wound on one tube and the other is wound on the other tube. Each tube has a circumferential groove about midway of its length for picking up a yarn end from the cam to make the throw-on. The cam 3 includes a pair of helical grooves (not shown) on its outer periphery for guiding the yarn in an axially reciprocal path along the respective packages during the winding operation.

A typical metier has a large number of winding stations which are situated in side-by-side relationship. According to the invention, an automated yarn package doffing machine is provided, including primary and secondary doffing frame assemblies 10 and 200 which traverse the metier, from station to station. The frame assemblies include means for handling the yarn and the bobbin supporting mechanism to enable filled packages to be doffed and empty packages to be donned in sequence.

PRIMARY FRAME ASSEMBLY

Figure 2:
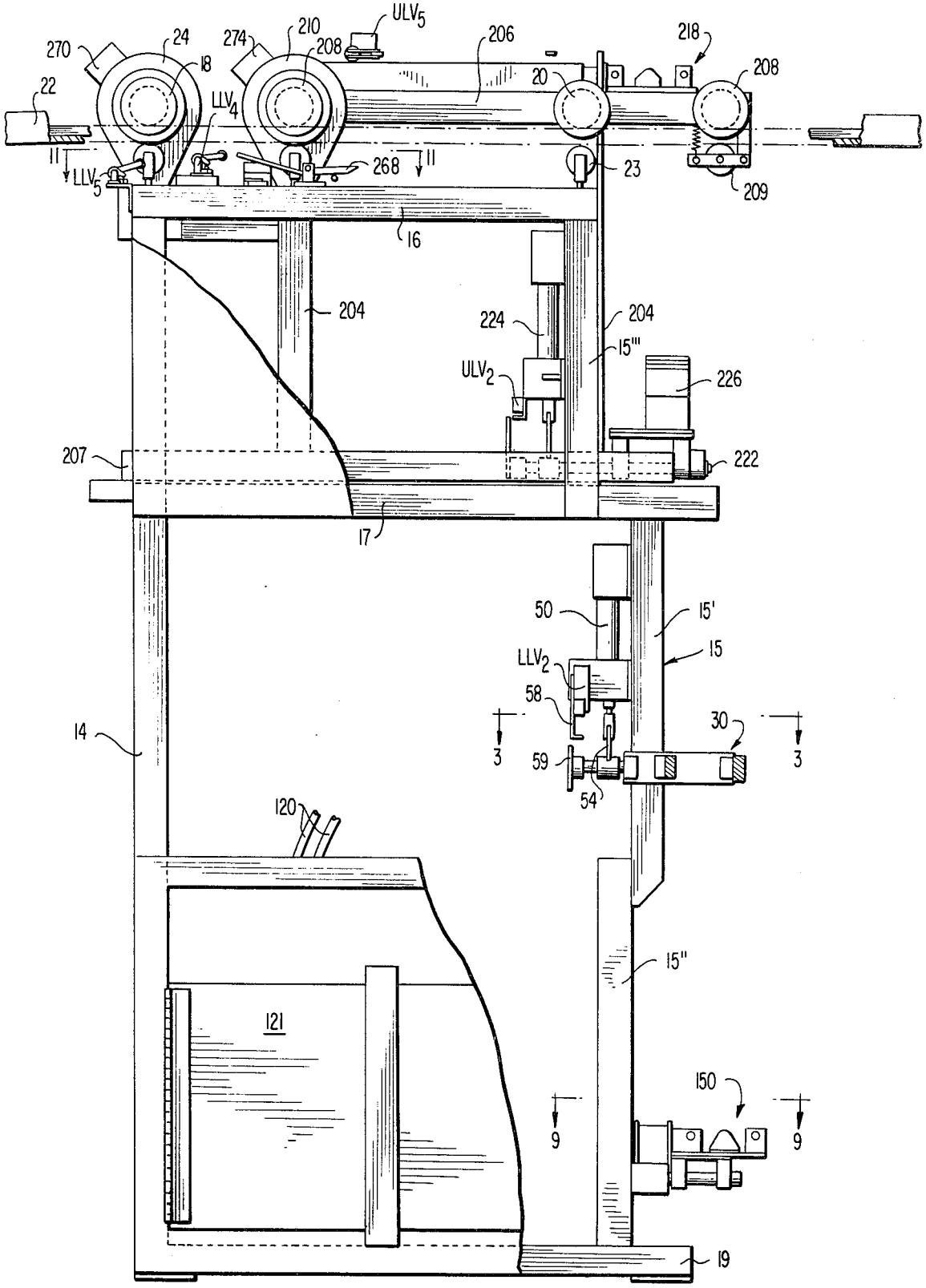
FIG. 2 is a front elevational view, partly broken away, of the doffing machine.

The primary doffing frame assembly 10 comprises a primary frame 12 which includes vertical end braces 14 and 15 (FIGS. 1 and 2). The brace 15 includes a plurality of brace portions 15′, 15″, and 15‴. Interconnecting the vertical braces are a plurality of horizontal braces 16, 17, and 19. The horizontal and vertical braces are thus interconnected to function as a unitary frame 12. Secured to brackets extending upwardly from the horizontal brace 16 are a pair of spaced support wheels 18 and 20 which roll along a stationary overhead track 22. Guide rollers 23 on the brace 16 engage the lower surface of the track. The guide rollers 23 may be slightly spring biased to increase the traction forces between the driving wheels 18 and 20 and the track 22, and constrain the machine from "jumping" the track.

A motor 24, preferably of the pneumatic fluid-driven type, drives the support wheel 18. In this fashion, the primary frame 12 is suspended from the track 22 by the wheels 18 and 20 and may be propelled along the metier by the motor 24. The bottom of the primary frame 12 may be provided with pairs of horizontally spaced wheels 26 (FIG. 1) which straddle a stationary rail 28, thus providing additional stabilization of the primary frame.

Yarn Handling

The primary doffing assembly 10 includes a primary yarn handling assembly 30 which is illustrated principally in FIGS. 1 to 8. The primary handling assembly includes a base plate 32 which has a pair of bearing blocks 34 mounted on a horizontal pivot rod 35. The pivot rod 35 is rotatably attached to the vertical brace portion 15′ by means of a pair of bearing blocks 36 on a plate 38, which is fixed to the brace portion 15′.

A bracket 42 is fixedly secured to the pivot rod 35 and extends outwardly therefrom. The bracket 42 includes a plurality of apertures 44 which may be selectively aligned with an aperture in the adjacent block 34. A bolt 37, passing through the aligned apertures, serves to interconnect the base plate 32 and the pivot rod 35 which may be swung vertically as a unit.

A counterweight 46 is attached to the bearing blocks 34 by means of bolts 48. The counterweight 46 is adapted to removably carry a selective number of shims 50' to enable the mass thereof to be varied.

An extendable link, in the form of a swing cylinder 50 driven preferably by pneumatic pressure, is mounted on the brace portion 15' and is connected at its rod end 52 to a crank arm 54. The crank arm 54 is provided with a collar 56 affixed to the pivot rod 35 and thereby functions as a crank arm for the pivot rod 35 and the base plate 32. Extension and retraction of the cylinder 50 induces vertical swinging movement of the handling assembly 30 between a raised position, as shown in full lines in FIG. 1, and a lowered position, as shown in phantom lines in FIG. 1. A mechanical limit valve $LLV_2$ is mounted on the brace portion 15' and includes an actuator lever 58 which contacts a cam 59 mounted on the pivot rod 35. Rotary movement of the pivot rod 35 will be sensed by the valve $LLV_2$.

Figure 3:
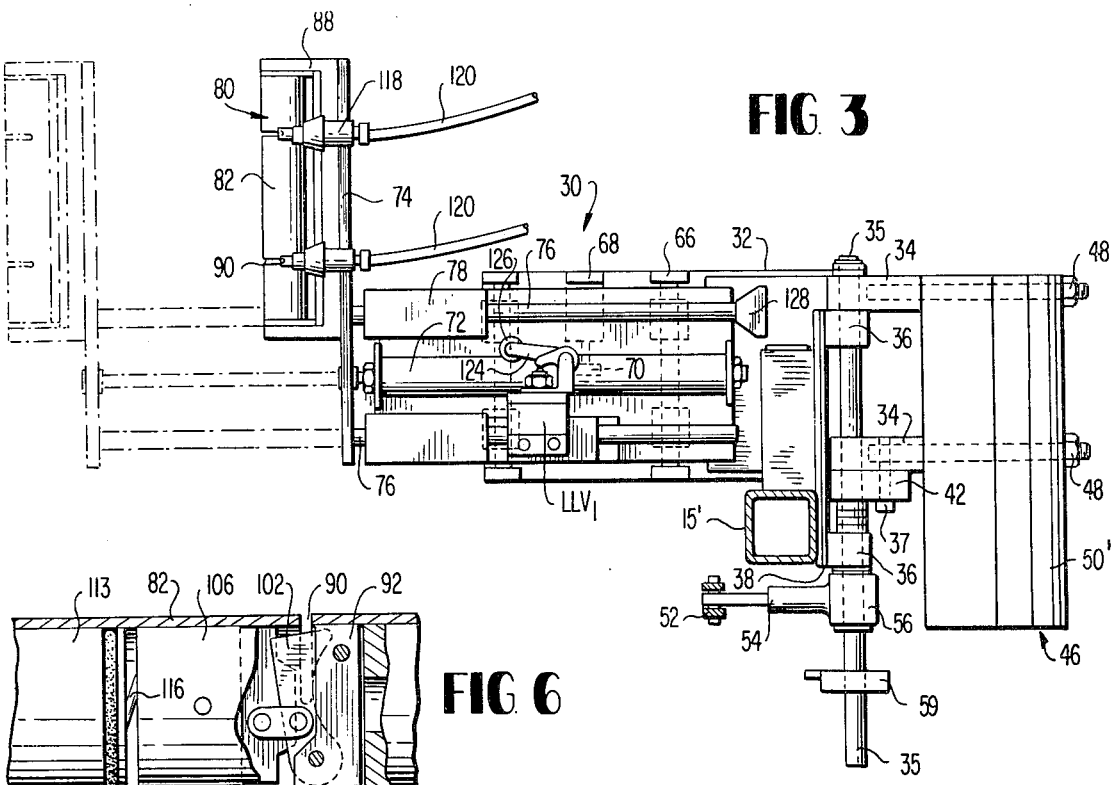
FIG. 3 is a cross-sectional view along the line 3—3 in FIG. 2 illustrating the primary handling assembly.
Figure 4:
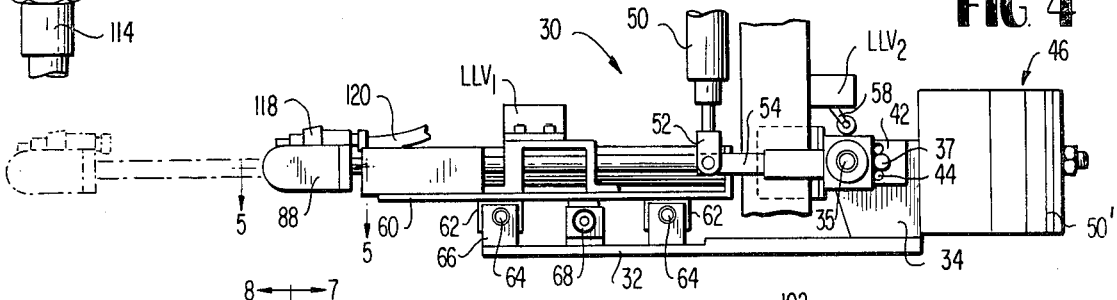
FIG. 4 is an enlarged side elevational view of the primary handling assembly.
Figure 5:
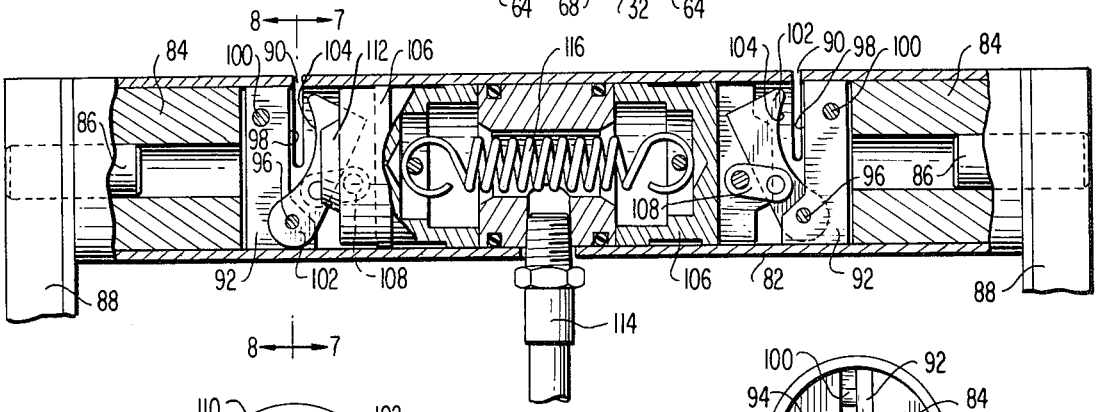
FIG. 5 is an enlarged cross-sectional view of the primary handling head along the line 5—5 of FIG. 4.
Figure 7:
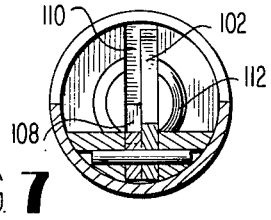
FIG. 7 is a cross-sectional view along the line 7—7 in FIG. 5.

The handling assembly further includes a shift plate 60 (FIGS. 3, 4). The shift plate 60 is provided with a pair of downwardly extending brackets 62 which house horizontal guide pins 64. The guide pins 64 are slidably supported within a pair of ears 66 which project upwardly from the base plate 32. A pneumatically-operated shift cylinder 68 is mounted on the base plate 32 beneath the shift plate 60. The rod end of the shift cylinder is attached to a bracket 70 which projects downwardly from the shift plate 60. The spacing between the brackets 62 and the ears 66 is arranged to permit the shift plate 60 to be shifted laterally upon expansion and retraction of the shift cylinder 68.

Fastened to the top of the shift plate 60, by means of brackets 70, is an extensible member in the form of a pneumatic cylinder 72. The cylinder 72 has, secured to its rod end, a transverse arm 74. The transverse arm 74 is provided with a pair of guide rods 76 which are slidably receivable within sleeves 78 carried by the shift plate 60. The provision of guide rods 76 within the sleeves 78 assures that the arm 74 will travel in a substantially straight, predetermined path upon extension of the cylinder 72, as shown in broken lines in FIG. 3.

Mounted on the outer face of the arm 74 is an end handling head 80. As shown primarily in FIGS. 5–8, the handling head 80 comprises a generally cylindrical housing 82. The housing 82 is closed at its ends by means of plugs 84. A pair of connecting pins 86 are mounted in the plugs 84 and are fastened to the legs of a U-shaped bracket 88, the latter being fixed to the arm 74.

Figure 8:
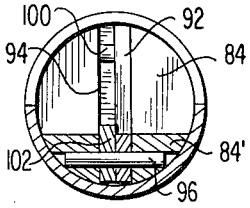
FIG. 8 is a cross-sectional view along the line 8—8 in FIG. 5.
Figure 9:
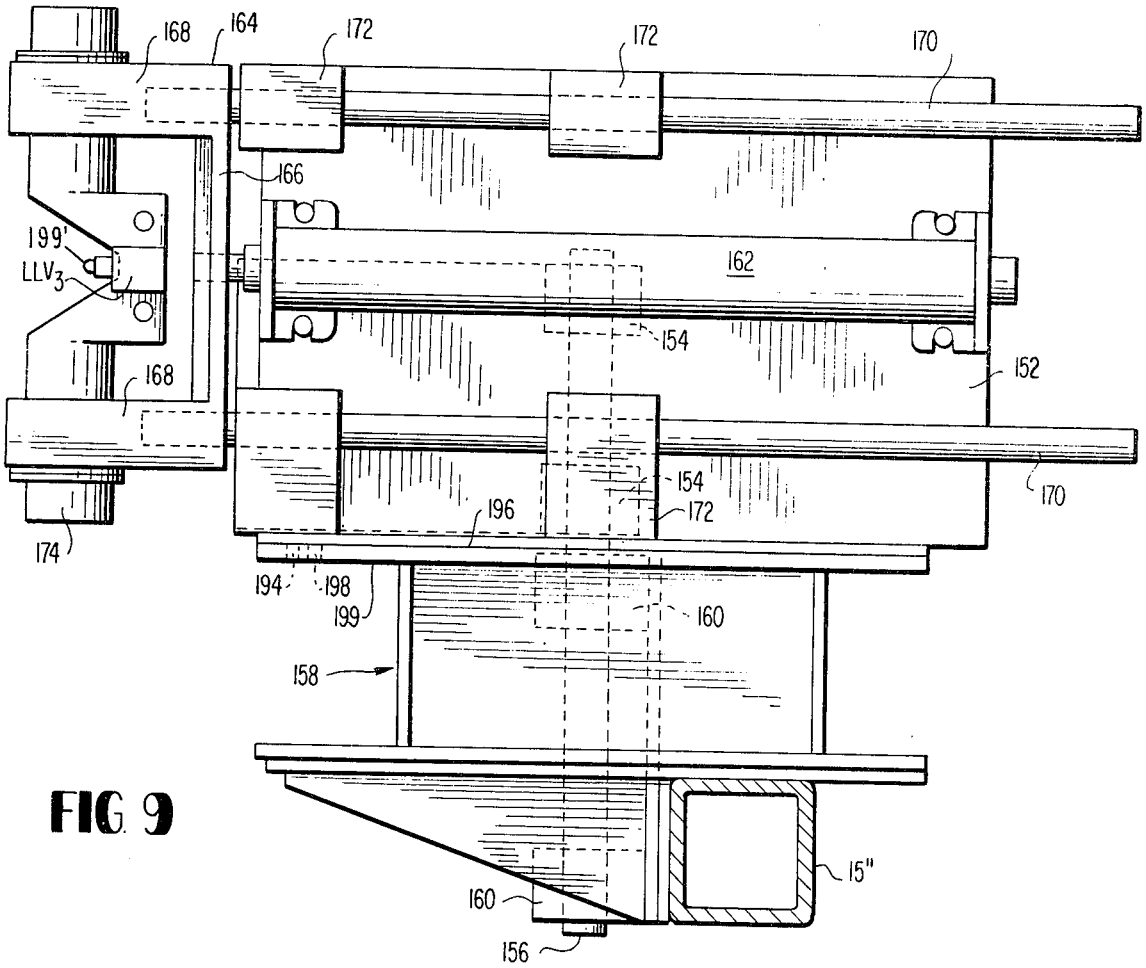
FIG. 9 is a cross-sectional view of the doffing machine along the line 9—9 in FIG. 2, illustrating the primary grabber assembly.

The housing 82 is provided with a pair of slots 90 facing generally in the direction of movement of the arm 74. Mounted within the housing 82 adjacent the slots 90 are identical yarn severing mechanisms. The severing mechanisms each comprises a stationary blade member 92 which is secured to the plug 84 within a groove 94 formed in the plug (FIG. 8). An extended portion 84 of the plug receives a securing pin 96 passing through the stationary blade 92. The stationary blade is provided with a sharpened edge 98 and a stop pin 100 projects across the groove 94.

Pivotally mounted on the pin 96 is a reciprocal or swingable shearing knife 102. The knife 102 is provided with a sharpened edge 104 which cooperates in a shearing relationship with the sharpened edge 98 of the blade member 92. The knife 102 is connected to a reciprocal piston 106 by means of a pivoted link 108. The knife 102 and the link 108 are received within a groove 110 of the piston 106 and are guided for movement by a pair of guide shoulders 112 which project from the piston 106.

Figure 6:
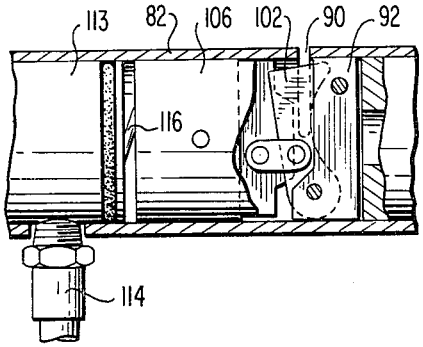
FIG. 6 is an enlarged, fragmental view of the primary handling head as in FIG. 5, but showing the knife displaced for cutting.

A block 113 is mounted in the interior of the tubular housing 82 between the pistons 106. The block 113 is held stationary by a threaded end of an inlet conduit 114. The piston 106 is shiftable toward the stationary blade member 92 in response to air under pressure received from the inlet conduit 114. The pistons 106 of the respective severing mechanisms are interconnected by means of a spring 116 which biases the pistons and the knives 102, to a retracted non-severing position abutting the block 113. It is apparent that air pressure in the interior of the block 113 causes the knives 102 to shift in a scissoring motion (FIG. 6).

Mounted on the housing 82 of the handling head 80 is a pair of suction elements, preferably in the form of aspirators 118 (FIGS. 3 and 4). Each aspirator 118 is disposed in generally vertical alignment with a respective one of the slots 90. The aspirators 118 are provided with suitable discharge conduits, such as flexible tubes 120, which place the aspirators in communication with a waste container 121 mounted on the primary frame 12 (FIG. 2).

The handling head 80 moves toward the pair of yarn ends Y' by extension of the cylinder 72 to allow each yarn to pass through one of the slots 90 as the yarn passes from the feed roll. At the proper time, air is conducted under pressure to the interior of the block 113 to displace the pistons 106 outwardly, thereby causing the knives 102 to cut the yarn ends Y'. After the ends have been cut, the end from the feed roll 1 is drawn into the waste container 121 by the aspirator 118.

The cylinder 72 is arranged such that, upon extension of the handling head 80 the tubular housing 82 engages the yarn ends. Since the yarn ends are oscillating between the feed roll 1 and the cam 3, the yarn ends will travel into alignment with the slots 90 such that the yarn ends will enter the slots 90.

In order to provide an actuation signal for the knife actuating pistons 106 at the end of the stroke of the cylinder 72, a limit valve $LLV_1$ is mounted on the shift plate 60 and is provided with a pivotal arm 124 having a roller 126 at its end. An abutment 128 is disposed on the end of one of the guide rods 64 and is arranged to contact the roller 126 and actuate the valve $ULV_1$ at the end of the stroke of the cylinder 72.

Package Handling

The primary doffing assembly 10 also includes a grabber assembly 150, as is chiefly illustrated in FIGS. 1, 2, 9, and 10. The function of the grabber assembly 150 is to automatically shift the packages 4 of the lower winding assembly toward and away from the cam 3 in coordinated, or timed, relation to the operation of the yarn handling assembly 30. In this fashion, replacement of the filled packages with empty packages may easily be accomplished by the operator.

The primary grabber assembly 150 comprises a support plate 152 which is pivotally mounted, by means of apertured ears 154, to a pivot bar 156. The pivot bar 156 is secured to the lower brace portion 15'' of the vertical brace 15 by means of a suitable bracket arrangement 158, including a pair of apertured legs 160. A fluid-actuated grabber cylinder 162 is fastened to the upper side of the support plate 152. Secured to the rod end of the grabber cylinder 162 is a grabber head 164. The grabber head 164 includes a U-shaped mounting frame which comprises a back element 166 and a pair of legs 168 projecting therefrom. The rod end of the grabber cylinder 162 is secured to the back element 166. A pair of guide rods 170 are slidably fastened to a plurality of brackets 172 mounted on the support plate 152. The legs 168 are fixed to the guide rods 70 to facilitate linear travel of the grabber head 164.

Affixed within apertures of the legs 168 is a generally transversely arranged grabber housing 174. The ends of the grabber housing are generally cylindrical in configuration, defining interior chambers 176 which are closed by means of end plugs 178. Slidably disposed within the chamber 176 is a pair of pistons 180. Attached to the pistons are jaw elements 182 which are slidable toward and away from one another in the grabber housing 174. Suitable air conduits 183 and 185 are provided to selectively conduct air under pressure to either side of the piston 180 to reciprocate the jaws 182. Alternatively, the pistons 180 could be air actuated in one direction only, and spring biased in the other direction.

The central part of the grabber housing 174 has a V-shaped notch 184. This notch is dimensioned to receive the crank arm 9 of the lower winding assembly. The outer ends of the jaws 182 are provided with projections 186 which prevent movement of the crank arm 9 out of the notch 184 when the jaws 182 are extended to the position shown in FIG. 10. Guide pins 190 may be fixed to the plugs 178 and slidably received within the jaws 182 to guide the jaws as they are being displaced.

The grabber head 164 may be extended toward the crank arm 9 by the grabber cylinder 162 until the crank arm engages the bottom of the notch 184. The jaw elements 182 are then extended to grasp the crank arm 9. Further extension of the grabber head 164 by the grabber cylinder causes the lever 6 supporting the bobbins 4 to be displaced away from the cam 3, as shown in phantom lines in FIG. 1. Retracting the grabber cylinder 162 brings the packages into contact with the cam 3. As soon as the counterweights 8 are in a position to urge the packages 4 into engagement with the cam 3, the jaw elements are retracted and the grabber head returns to the position shown in FIG. 1.

In order to limit the amount of pivoting which is afforded the grabber cylinder 162, the support plate 152 may be provided with a stop element 194. This stop element is fixed to a wall 196 which is attached to the support plate 152. The stop element 194 is disposed for limited sluding movement within a slot 198 which is carried by a stationary frame member 199.

Figure 10:
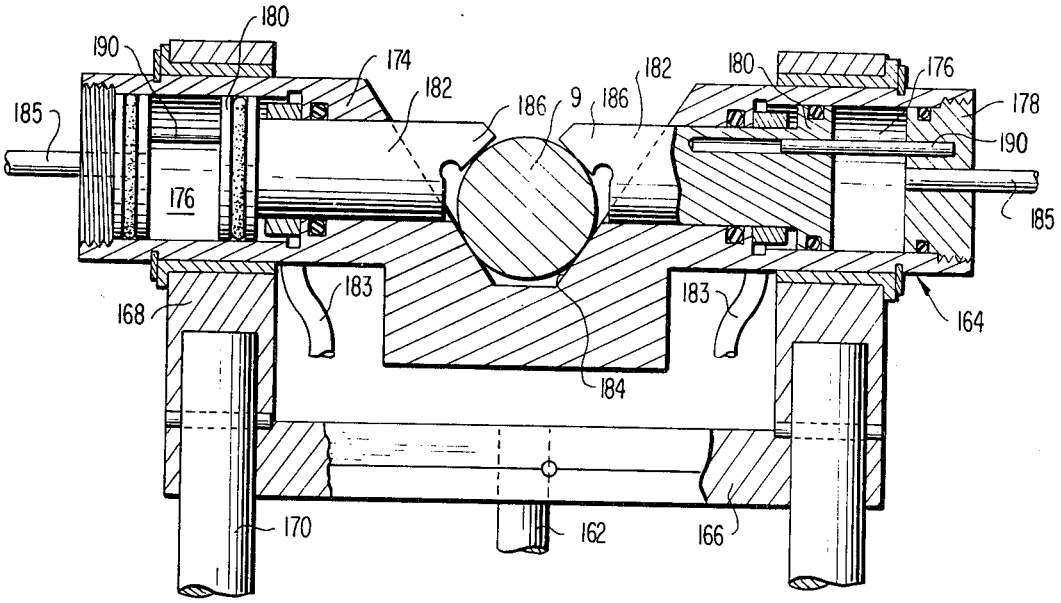
FIG. 10 is a transverse cross-sectional view of the primary grabber head.

A limit valve LLV3 is provided in association with the grabber cylinder 162 to sense the presence of the crank arm 9 and activate the jaws 182 when the grabber head has been extended (FIG. 10). At some time during the winding of a package, one or more of the yarn ends being extruded on the metier may break. When this occurs, a patrolling operator removes the particular package affected and initiates the winding of a new package after correcting the condition that caused the break. Consequently, there may be several small (i.e. unfilled) packages on the metier when the predetermined doff time arrives. Where these occur the crank arm 9 will be at a location other than normal for a full doff. Since the crank arm should be under control when being moved, the limit valve LLV3 will be actuated upon contacting the crank arm, to extend the jaws 182. The valve LLV3 includes a spring-biased pin 199' which extends into the notch 184 wherein it may be activated upon contacting the crank arm 9.

Figure 14D:
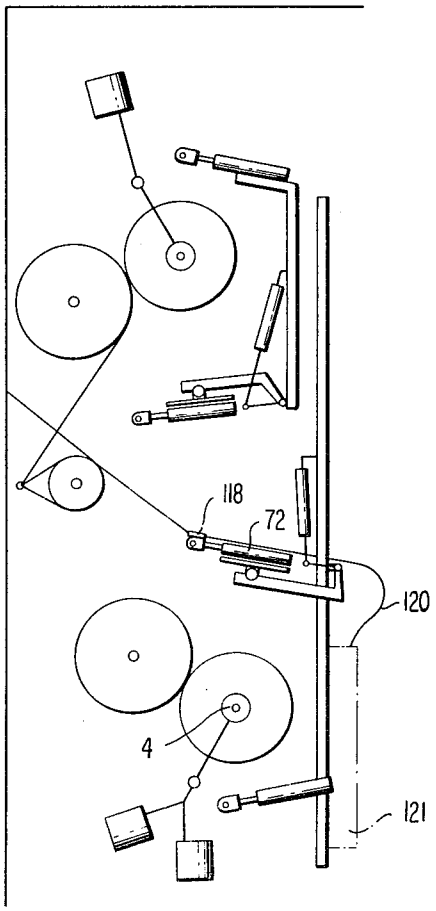
FIGS. 14A through 14P are schematic views depicting the sequence of operation of the doffing machine, with FIGS. 14A through 14J and FIGS. 14M through 14O being side elevational views, and FIGS. 14K and 14P being front elevational views.
Figure 14C:
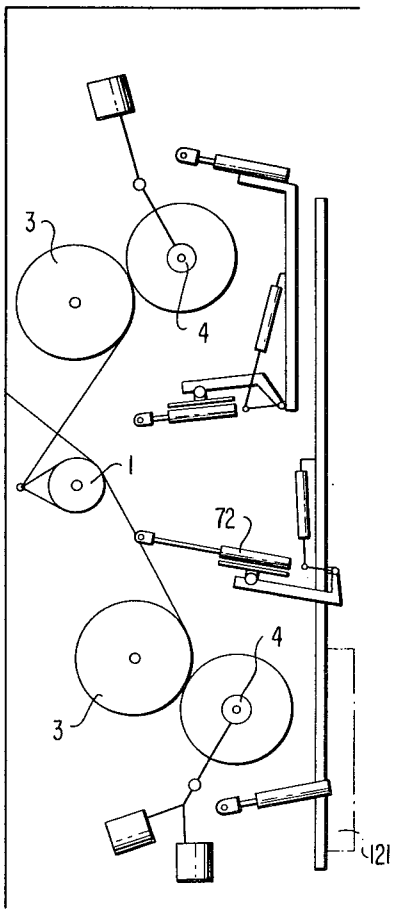
Figure 14B:
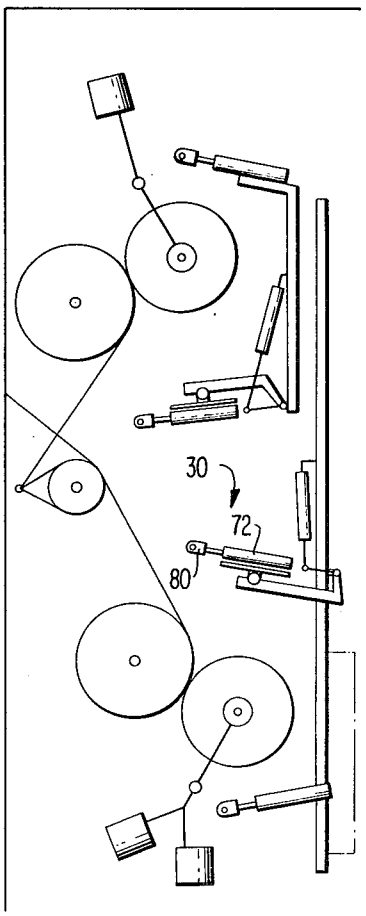
Figure 14A:
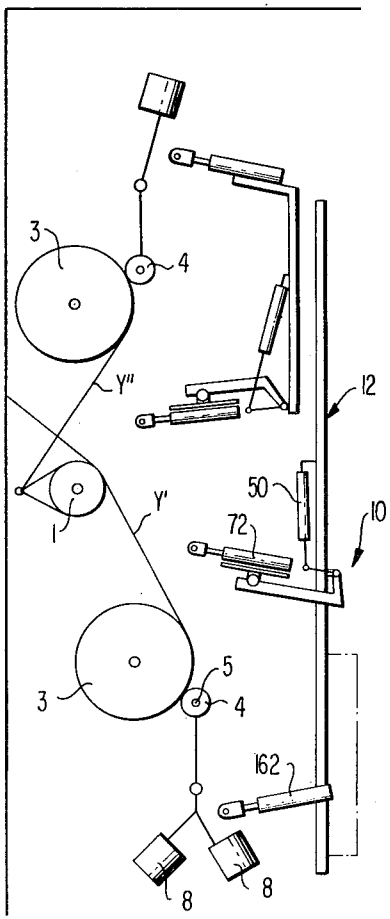
Figure 14H:
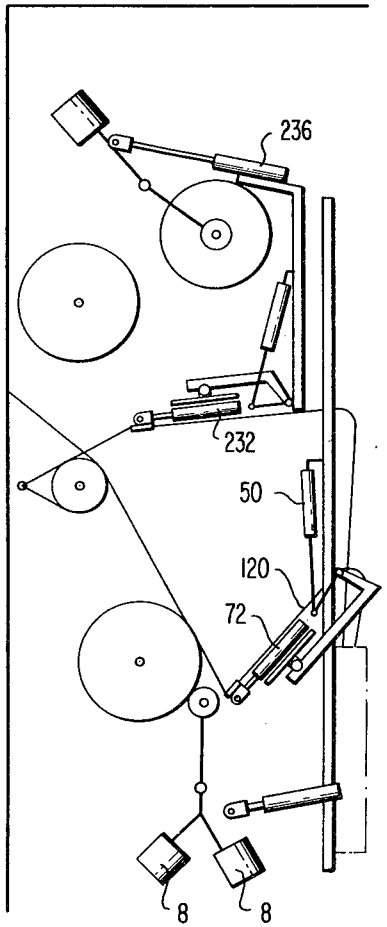
Figure 14G:
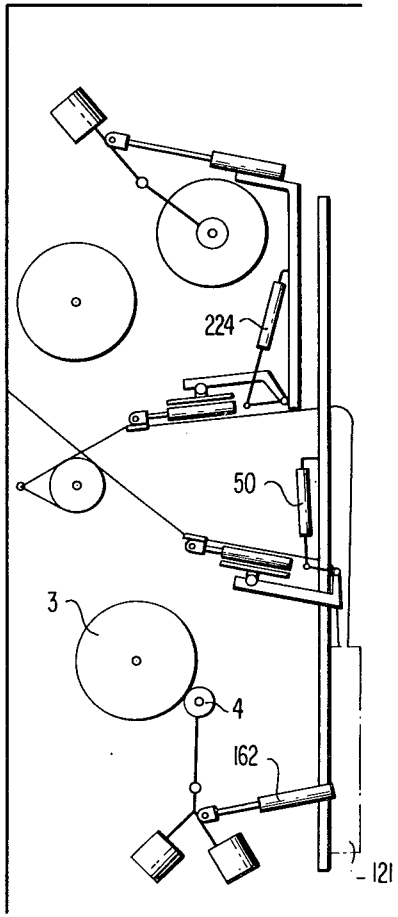
Figure 14F:
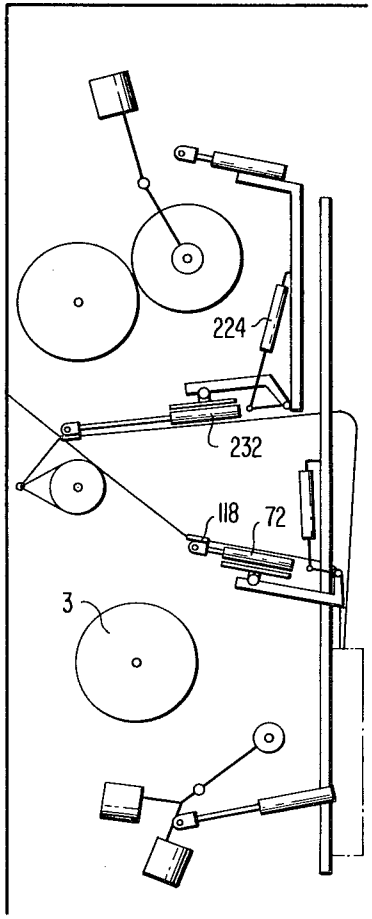
Figure 14E:
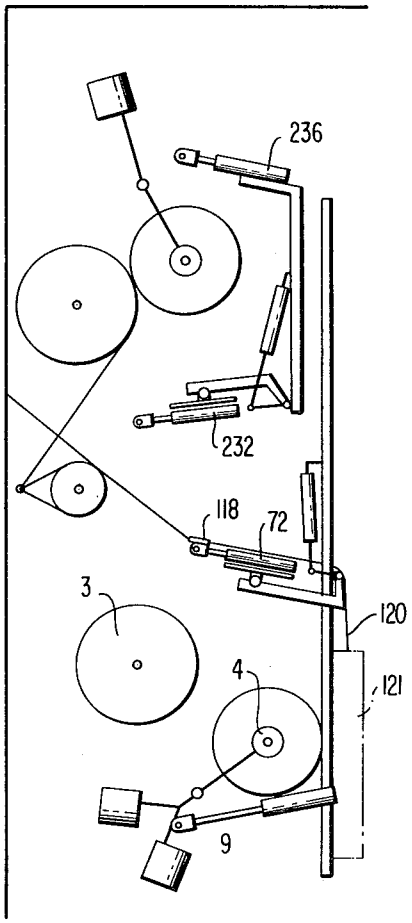
Figure 14L:
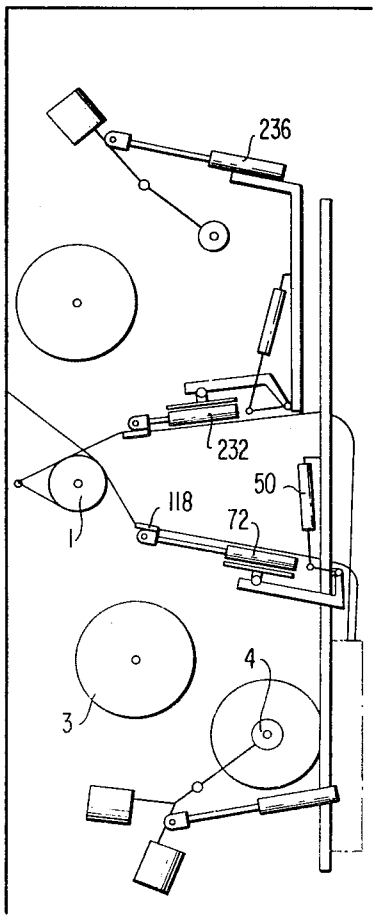
Figure 14K:
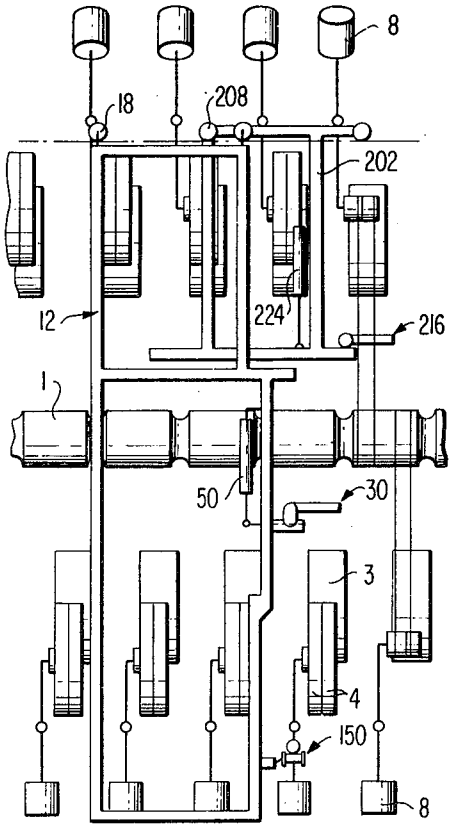
Figure 14J:
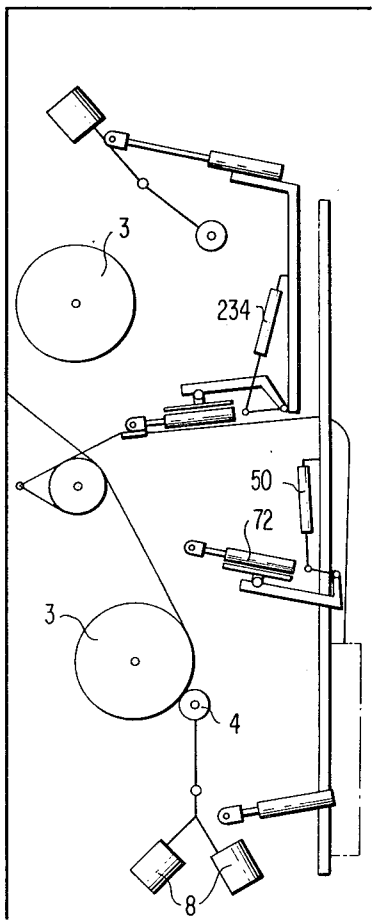
Figure 14I:
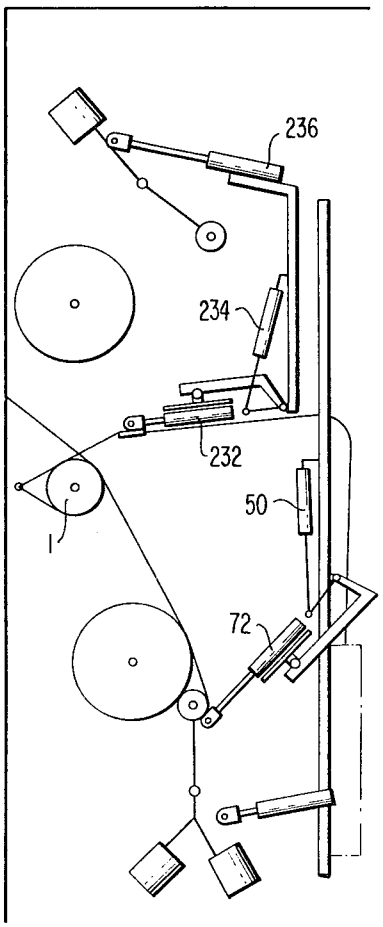

A brief description of the operation of the primary handling and grabbing assemblies will now be presented with respect to FIGS. 14*a* through 14*j*. When the packages of the lower winding assembly are filled, the handling cylinder 72 is extended to bring the handling head 80 into engagement with the yarn ends Y' (FIGS. 3 and 14*c*). Oscillation of the yarn ends, as caused by the cam 3, will cause the yarn ends to enter the slots 90. The knives 102 are then actuated to sever the yarn ends which are then captured and drawn to waste by the aspirators 118 (FIG. 14*d*). The handling cylinder 72 is then retracted, with the yarn from the feed roll 1 being conducted from the aspirators 118 through the conduits 120 to the waste container 121. The grabber cylinder 162 is then extended to move filled packages 4 out of driven engagement with the cam 3 (FIG. 14*e*). The filled packages are then manually removed by the operator and replaced by empty packages (FIGS. 14*f* and 14*g*). The swing cylinder 50 is extended to swing the handling cylinder 72 to a lowered position (FIG. 14*h*), whereupon the handling cylinder is extended generally toward the empty packages. The yarn ends are picked up by the pinch grooves of the empty tubular packages, said pinch groove being positioned in the center of each tubular package and running circumferentially about the package, thus accomplishing the throw-on, as in conventional practice. As the yarn begins to wind on the packages, it breaks at the aspirator 118. In this manner, the waste yarn is effectively separated from the yarn being wound (FIG. 14*i*).

SECONDARY DOFFING ASSEMBLY

A secondary doffing assembly 200 is preferably provided for the doffing of the upper winding assembly of each winding station. As shown in FIGS. 1 and 2, the secondary doffing assembly comprises a secondary frame 202 which includes a pair of vertical braces 204 and a pair of horizontal braces 206 and 207. The frame 202 is provided with a pair of spaced support wheels 208 which serve to suspend the frame 202 from the track 22. Underlying rollers 209 are provided on the frame 202 to bear against the underside of the track. A fluid driven motor 210 is drivingly connected to one of the support wheels 208 for propelling the frame 202 along the track 22. A rail 212 extends from the horizontal brace 207 and is engaged on opposite sides by a pair of wheels 214 (FIG. 1) which are secured to the primary frame 12. In this manner, the secondary frame 202 is movable along the track 22 independently of the primary frame 12, while being partially supported and stabilized by the primary frame.

The secondary doffing assembly 200 includes a secondary handling assembly 216 and a secondary grabber assembly 218. The upper handling assembly 216 is substantially similar to the primary handling assembly 30 in that it includes a base plate 220 which is secured to a pivot rod 222. A swing cylinder 224 is attached between the secondary frame 202 and the pivot rod 222 to swing the secondary handling arm assembly between a severing and a throw-on position. This swinging movement is sensed by a limit valve $ULV_2$, in a manner similar to that of the valve $LLV_2$ associated with the primary doffing assembly.

The base plate 220 is provided with a counterweight 226 on its upper side and a shift plate 228 on its underside. A shift cylinder 230 is connected between the base plate and the shift plate to slide the shift plate laterally with respect to the base plate.

A secondary handling cylinder 232 is mounted beneath the shift plate 228 and is provided with a secondary handling head 234 comprising a severing and aspirating mechanism which is similar in structure and operation to that of the primary doffing assembly 10. Also, a limit valve $ULV_1$, similar in operation to the valve $LLV_1$, is provided for actuating the severing mechanism.

A secondary grabber arm assembly 218 is provided and includes a grabber cylinder 236 and a grabber head 238 similar in structure and operation to those of the primary doffing assembly. In addition, a limit valve $ULV_3$, similar to the valve $LLV_3$, is provided to sense movement of the secondary grabber head.

The operation of the primary and secondary doffing assemblies 10 and 200 are sequentially staggered in order that an operator in charge of manually substituting the packages may make efficient use of his time. Thus, the lower packages will be displaced from the cam prior to displacement of the upper packages.

It should also be noted that the upper and lower winding assemblies are not arranged in precise vertical alignment, but are slightly offset horizontally, as may be viewed in FIG. 14k.

Figure 11:
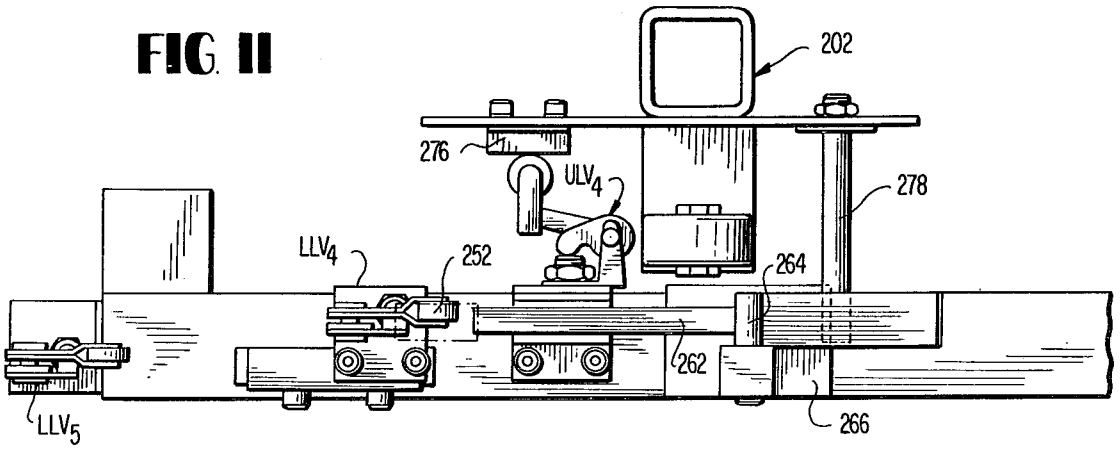
FIG. 11 is a cross-sectional view of the doffing machine along the line 11—11 in FIG. 2, illustrating the frame traversing and indexing mechanism.
Figure 12:
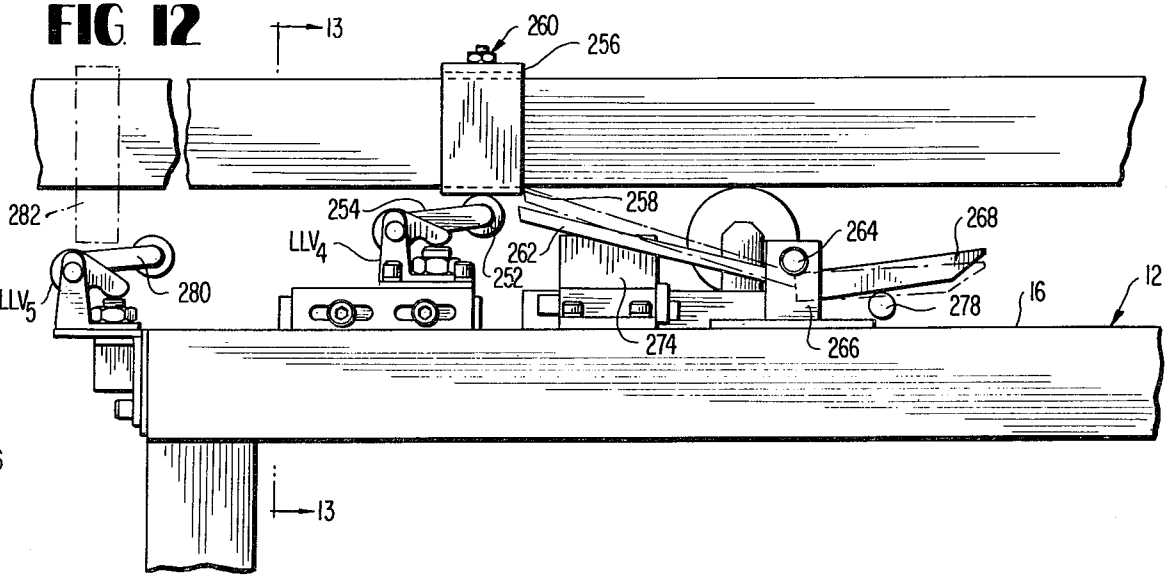
FIG. 12 is an enlarged, elevational detail view of the doffing machine of the traversing and indexing mechanism as in FIG. 11.
Figure 13:
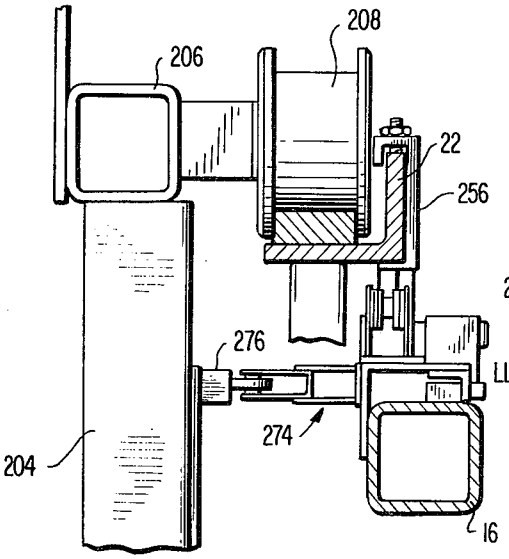
FIG. 13 is a cross-sectional view of the doffing machine along the line 13—13 in FIG. 12.

In order that the primary and secondary frames will be properly aligned with respect to the individual winding stations as the doffing machine traverses the metier, an aligning system is provided. Referring to FIGS. 11–13 it can be seen that the primary frame 12 has mounted thereon a limit valve $LLV_4$ which includes a roller 252 mounted on a pivoted lever 254. A cam bracket 256 is mounted on the track 22 and includes an abutment 258 which extends downwardly below the track. An adjustment screw 260 is provided to enable the cam bracket 256 to be at selected positions along the track 22.

A stop finger 262 is pivotally mounted by means of a pivot pin 264 to a bracket 266 which is attached to the primary frame 12. Projecting from the stop finger 262 is a weighted lever 268 which serves to bias the stop finger upwardly into engagement with the abutment ledge, as shown in FIG. 12.

The primary frame is arranged to travel beneath the track 22 such that the valve $LLV_4$ and the stop finger 262 will sequentially contact the cam bracket 256. The valve $LLV_4$ is operatively connected to a brake 270 which engages opposite sides of a disk 272 on the power shaft of the motor 24 (FIG. 1).

As the primary frame is being propelled along the track 22 toward a winding station (toward the left, as viewed in FIG. 12), the valve $LLV_4$ will immediately actuate the brake 270 and the primary frame will be substantially slowed. Momentarily thereafter, the stop finger 262 will contact the abutment ledge 258 to stop the primary doffing assembly at a predetermined location relative to the winding station. The primary doffing assembly will be held in this position by means of the brake 270, since the valve $LLV_4$ remains depressed. Consequently, the operations described previously in connection with FIG. 14 can be carried out, with the primary frame being secured in a substantially aligned manner adjacent the winding station.

The primary frame 12 travels ahead of the secondary frame 202. That is, the primary frame 12 propels itself to a subsequent winding station prior to the secondary frame. After the primary doffing assembly has begun the doffing operation, the secondary frame travels from the preceding station to the same station as the primary frame.

In order to provide a braking and aligning of the secondary frame 202, the motor 210 is provided with a brake 274 (FIG. 2), similar to the brake 270 of the motor 18. To actuate the brake 274 associated with the motor 210 a valve $ULV_4$ is provided (FIG. 11). This valve $ULV_4$ is mounted on the primary frame 12 and has a follower which extends toward the path of travel of the secondary frame. The secondary frame is provided with an adjustably positionable cam block 276 which engages the follower of valve $ULV_4$ and servies to activate the valve $ULV_4$ upon contact therewith. Thus, as the secondary frame arrives at its new destination, i.e., a subsequent winding station, the cam block 276 activates the valve $ULV_4$ to impart a braking action to the secondary frame. Due to the fact that the secondary frame 202 is considerably lighter in weight than than the primary frame, the brake 274 is sufficient to halt the secondary frame in an aligned position, in the absence of a positive stop engagement.

The secondary frame is provided with a stop pin 278. This stop pin 278 is fixedly attached to the secondary frame and overlaps the horizontal frame member 16 of the primary frame. The stop pin is positioned to travel beneath the weighted lever 268 and to cam the weighted lever upwardly until the pin 278 becomes wedged under the lever 268 (FIG. 12). In this fashion, the stop finger 262 will be released from engagement with the abutment 258 as the weighted lever is raised by the stop pin 278. The primary frame will not be moved, however, as it is being held by the brake 270, but will be free to move upon release of the brake 270 and activation of the motor 24.

In order to admit pressurized air to the pneumatic control circuit, for actuating the pneumatic power devices of the primary doffing assembly, a limit valve $LLV_5$ is mounted on the primary frame 12 and is provided with an actuating lever 280. The valve $LLV_5$ is normally disposed in an open position as the primary doffing assembly traverses the metier, admitting air to the pneumatic power devices. Attached to the track 22 at the end of the metier is a cam rail 282 (FIG. 12) which projects downwardly into the path of travel of the actuating lever 280. As the primary doffing assembly reaches the end of the metier, the lever 280 will be depressed as it contacts the stop rail, and the primary doffing assembly will become deactivated. A similar valve $ULV_5$ is provided for the secondary doffing assembly and functions in the same manner with respect thereto.

An important feature of the invention concerns the use of a timer-controlled master programmer 290 mounted on the primary frame 12, which functions to operate valves for controlling some of the pneumatic power devices. In this fashion, sequential operation of the doffing mechanism is provided without requiring numerous limit switches which would make the apparatus rather cumbersome to operate.

The master programmer 290 includes a plurality of valves $PV_1$–$PV_{12}$ and a plurality of rotary cams C operatively associated therewith. The cams are fixed to a rotatable shaft which is driven by a pneumatic motor 292. Rotation of the shaft at a constant, pre-selected, rate causes the cams C to acutate the valves $PV_1$–$PV_{12}$ sequentially. The valves $PV_1$–$PV_6$ are arranged in timed sequence and in conjunction with the operation of the limit valves $LLV_1$–$LLV_5$.

The pneumatic circuit includes main air inlet conduits 296, 298, and 299. The secondary conduits 296 and 298 direct working air to the various pneumatic power devices of the primary and secondary doffing assemblies, respectively. The secondary conduit 299 directs air to the pneumatic motor 292 for operation of the master programmer, and to a valve feed line 300. The valve feed line 200 divides into a pair of branches 302 and 304 which supply valve-actuating air pressure to the primary and secondary doffing assemblies, respectively.

The use of a pneumatic circuit for operating the doffing machine serves, as noted previously, to minimize the hazards of explosion due to the explosive atmosphere around the metier.

OPERATION

Figure 14P:
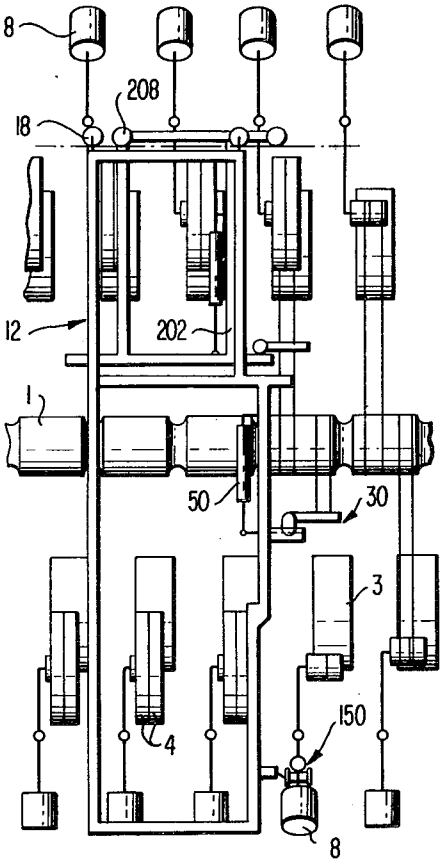
Figure 14O:
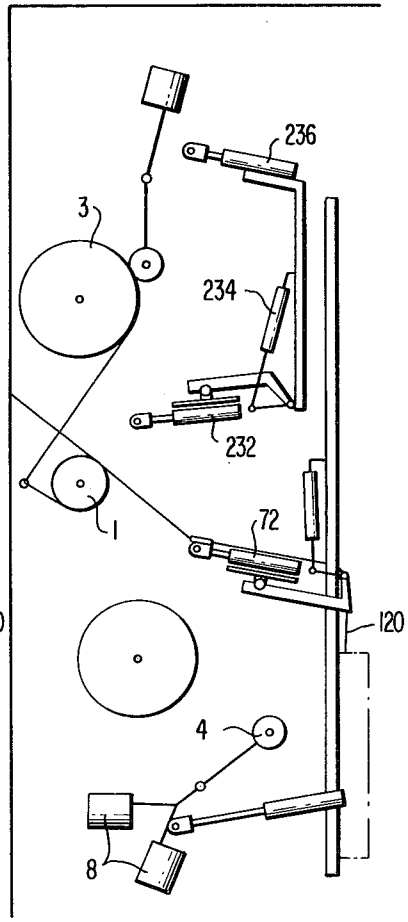
Figure 14N:
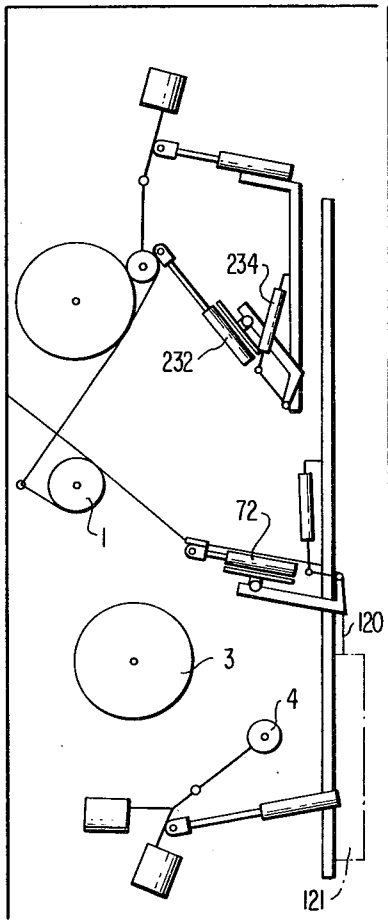
Figure 14M:
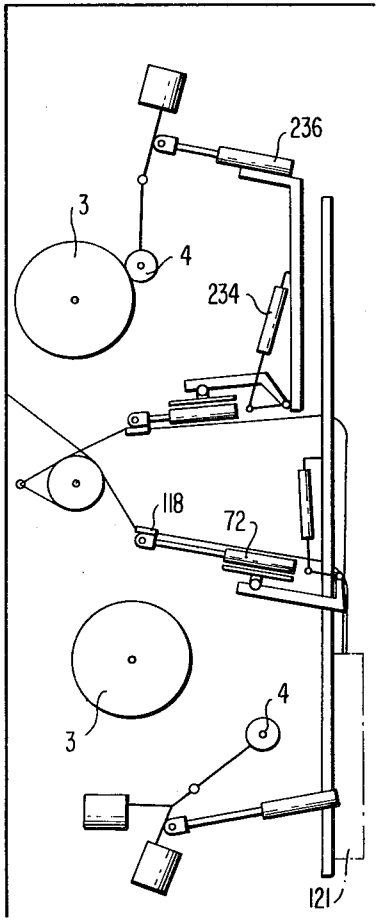

The operation of the doffing machine will be described primarily in connection with FIGS. 14*a*–14*p*.

The overhead tracks 22 extend along the length of the metier from a terminal position at one end of the metier to a starting position at the opposite end of the metier. Preferably, a hose reel is mounted adjacent the terminal position and air hoses are carried on hangers which move along the tracks to supply air to operate the components of the machine as the frames 10 and 200 travel along the metier. The reel automatically rewinds the hoses as the frames move progressively from the starting position to the terminal position.

FIG. 14*a* illustrates a condition where the yarn ends Y′ and Y″ are being wound upon the packages 4 from the feed roll 1 at the initial winding station. The doffing machine at this point is in a non-activated condition. As the packages 4 become filled with yarn, the spindles 5 are gradually shifted away from the cams 3 against the bias of the counterweights (FIG. 14*b*). During the winding operation, the helical grooves in the cam periphery cause the yarn ends Y′ to be reciprocated axially along the respective packages to provide a uniform filling of the packages.

Figure 15:
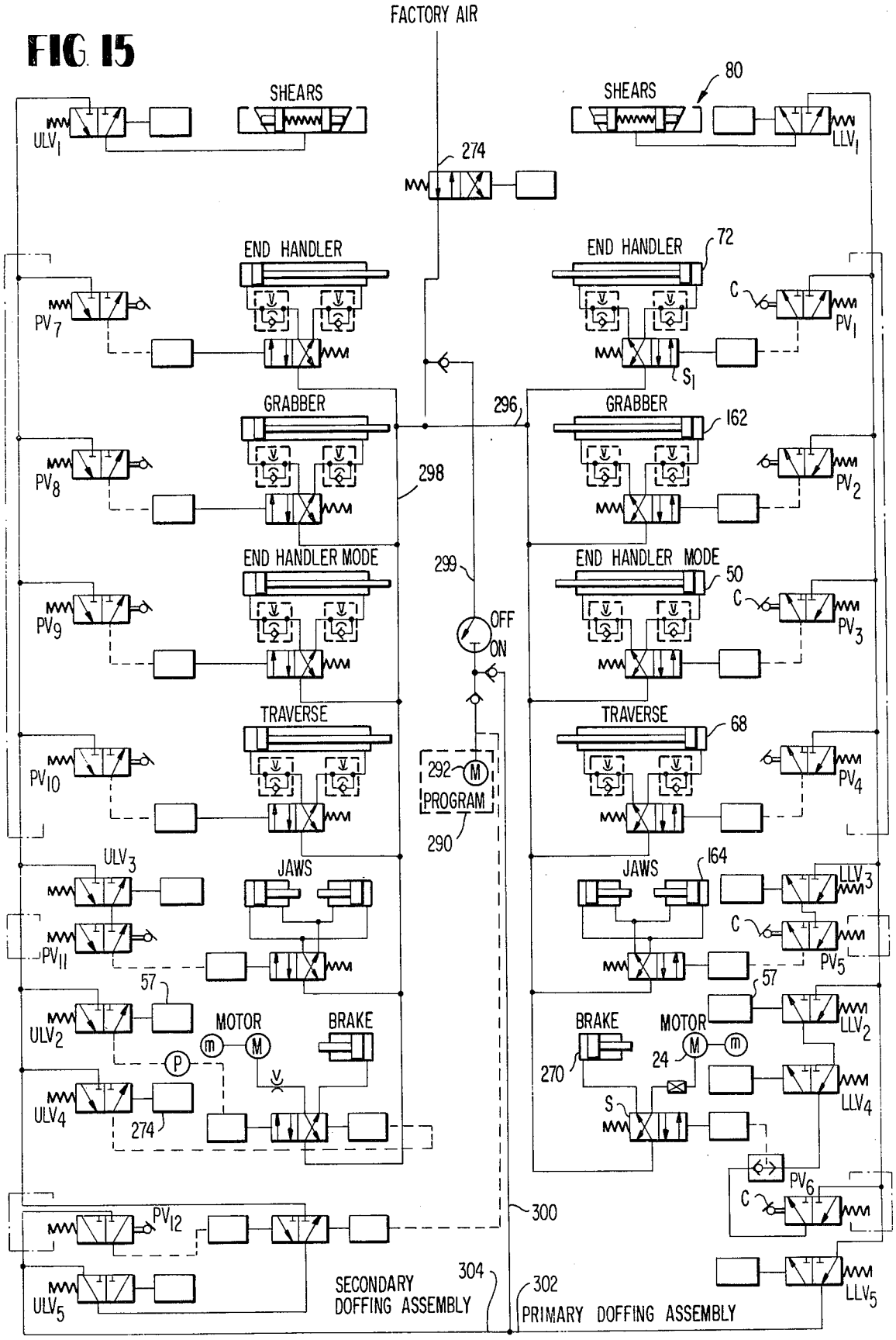
FIG. 15 is a diagrammatical representation of the pneumatic control circuit employed in operating the doffing machine.

When the lower packages have been filled, an operator activates the pneumatic control circuit. Air pressure is thus supplied to the main supply conduits 296, 298, 302, and 304 and the cam shaft motor 292 of the master programmer (FIG. 15).

Following a pre-selected rotation of the cam shaft, the valve $PV_1$ is activated to cause air to be admitted to the piston side of the handling cylinder 72. The handling cylinder is extended and carries the handling head 80 into contact with the yarn ends Y′ (FIGS. 3 and 14*c*). The yarn ends are caused to be slightly tensioned against the peripheral surface of the housing 82 in this condition.

Oscillation of the yarn ends by the cam 3 causes the yarn aligned with ends to become aligned with the slots 90, at which time they will enter the slots. The valve $LLV_1$ is actuated by the cam 128 which is connected to the handling cylinder 72, and causes air to be directed against the knife-actuating pistons 106 within the housing 82. The ensuing extension of the pistons imparts a scissoring motion to the knives 102 whereby the yarn ends Y′ are severed. The severed yarn ends are immediately captured by suction from the aspirator 118. The waste yarn which continues to be fed by the feed roll 1 is drawn by the aspirator 118 into the waste container 121. Following a pre-selected interval, the valve $PV_1$ is deactivated and its associated spool S returns to a position whereby air is suitable directed to retract the handling cylinder 72 (FIG. 14*j*).

The programmer next causes the valve $PV_2$ to be cammed into a position causing the grabber cylinder 162 to be extended into engagement with the crank arm 9. The limit valve $LLV_3$ is activated in response to contact with the crank arm 9 to cause the jaws 182 to be extended into the notch to retain the crank arm 9 (FIG. 10). Further extension of the grabber cylinder 162 causes the packages 4 to be displaced from driven engagement with the cam 3 (FIG. 14*e*). At this point the operator is able to manually remove the filled packages 4 and replace them with empty packages (FIG. 14*f*).

Also at this point the secondary handling cylinder 232 is caused to extend and shear the yarn ends Y″ by sequential operation of the valves $PV_7$ and $ULV_1$. The severed ends are captured by the secondary aspirators and are drawn into the waste container (FIG. 14*g*).

Following the insertion of the empty packages, the primary grabber cylinder 162 is retracted, bringing the empty packages into driven engagement with the cam 3. The valve $PV_5$, meanwhile, overrides the valve $LLV_3$, causing the jaws 182 to be retracted and enabling the grabber cylinder to return to its initial or neutral position (FIG. 14*h*).

The upper packages have, meanwhile, been displaced from the upper cam 3 by the secondary grabber cylinder. The operator is now able to exchange the upper packages.

In order to initiate a new winding operation at the lower winding assembly, the swing cylinder 50 is actuated by the valve $PV_3$ to swing the primary handling cylinder to a downwardly projecting mode (FIG. 14*h*). The valve $PV_1$ induces a re-extension of the primary handling cylinder to guide the yarn ends Y′ into engagement with the bobbins 4. The shift cylinder 68 is actuated by the programmer to shift the yarn ends Y′ laterally across the pinch grooves in the bobbins. This insures that the yarn ends will be picked up by the pinch grooves to accomplish the throw-on. The suction force imparted to the yarn ends Y′ by the aspirators 118 which are aligned with the pinch grooves will be overcome by the winding force of the packages causing the yarn to break (FIG. 14*i*). Subsequently, the programmer causes the primary handling cylinder to retract and to be swung to a neutral position by the swing cylinder 50 (FIG. 14*j*).

With the primary doffing assembly having completed its doffing operation, the programmer 20 automatically activates the valve $PV_6$ to shift its associated spool valve S into a position for directing air to the air motor 24. The motor 24 rotates the wheel 18 and advances the primary frame 12 towards the next winding station, with the secondary frame 202 remaining stationary. As the primary frame arrives at the next winding station, the valve $LLV_4$ is activated by engagement with the cam bracket 256 and causes the brake 270 to be applied (FIG. 12). The primary frame is thus slowed and the stop finger 262 contacts the ledge 258 to stop the primary frame in a suitably aligned position facing the lower winding assembly, as illustrated in FIGS. 12 and 14*k*. Once in this position, the primary handling and grabber assemblies repeat the doffing operation.

Following the insertion of the empty packages onto the upper spindle 5, the secondary grabber cylinder 236 is retracted to reposition the upper packages into driven engagement against the upper cam (FIG. 14). The secondary cylinder is then swung upwardly and extended to accomplish the throw-on in generally the same manner as the primary handling cylinder (FIG. 14*n*), and is returned to a neutral position. With the secondary doffing assembly having completed its doff, the motor 210 is actuated by the programmer to advance the secondary frame to the upper winding assembly of the next winding station.

As the secondary frame approaches the primary frame, the cam bracket 256 contacts the valve $ULV_4$ which projects from the primary frame (FIG. 12). This actuates the brake associated with the motor 210 and slows the secondary frame to a stop. The stop pin 278 engages and lifts the weighted lever 268 as the secondary frame is slowing to a stop. Consequently, the stop finger 262 will be released from engagement with the ledge 258. In this position the secondary frame will be suitably aligned with the next winding assembly (FIG. 14*p*).

The primary doffing assembly will then complete its doffing operation and the secondary doffing assembly will begin a new doffing operation.

It will be apparent that in view of the teachings of the invention, the yarn handling assembly 30, in lieu of being mounted on a movable frame, could be fixed to a stationary frame. In such a case, each winding assembly would be provided with an individual handling assembly located adjacent thereto which would be operable to sever, capture, and accomplish a throw-on with respect to the bobbins. Each winding station would be provided individually with a mechanism for displacing the packages relative to the cam in conjunction with the operation of the handling assembly.

If desired, some form of automated device could be utilized in conjunction with the disclosed apparatus for mechanically removing and replacing the packages.

ADVANTAGES AND SCOPE OF THE INVENTION

The present invention provides a yarn handling assembly which is capable of severing, capturing, and accomplishing a throw-on all without operator assistance.

The self-propelling and self-aligning features of the disclosed doffing machine enables the machine to automatically traverse an entire metier while aligning itself automatically at successive winding stations.

The doffing machine of the instant invention enables a single operator to doff an entire metier while merely removing and replacing packages.

The timed pneumatic circuit disclosed for operating the doffing machine affords an automatic functioning of the apparatus with a minimal number of limit valves. In addition, the pneumatic circuit reduces the risk of explosion.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A method of doffing yarn packages at a plurality of yarn winding stations spaced along the length of a metier, said winding stations each having upper and lower package spindles on which yarn packages are wound, said method comprising the steps of:

(a) advancing a primary frame along a track extending along the length of said metier;

(b) stopping said primary frame at a predetermined position along said track;

(c) displacing a primary handling head relative to said primary frame to remove an upper full package spindle;

(d) severing yarn adjacent said full package spindle;

(e) replacing said upper full package spindle with an upper empty package spindle and subsequently accomplishing a throw-on of said yarn on said upper empty package spindle;

(f) advancing a secondary frame along said track toward said primary frame;

(g) stopping said secondary frame in response to engagement with said primary frame; and (h) displacing a secondary handling head relative to said secondary frame in sequence to remove a lower full package spindle;

(i) severing yarn adjacent said lower full package spindle;

(j) replacing said lower full package spindle with a lower empty package spindle and subsequently accomplishing a throw-on of said yarn on said lower empty package spindle.

2. A method of doffing according to claim 1 wherein; said step of stopping said primary frame includes the step of:

applying a brake to slow the advance of the primary frame relative to said track and subsequently stopping said primary frame at said predetermined position by causing a stop finger on said primary frame to contact a stop disposed on said track.

3. A method of doffing according to claim 2 wherein: said step of stopping said secondary frame includes the steps of:

causing a brake acutating means on one of said primary and secondary frames to be activated by engagement with a cam element on the other of said primary and secondary frames, said brake actuating means applying a brake to halt the advance of said secondary frame relative to said track.

4. A method of doffing according to claim 3 wherein said step of stopping said secondary frame includes the step of disengaging said stop finger from said stop.

5. A method of doffing according to claim 4 including the additional step of advancing said primary frame along said track subsequent to said stop finger being disengaged from said stop.

* * * * *